US005250874A

United States Patent [19]

Hall et al.

[11] Patent Number: 5,250,874

[45] Date of Patent: Oct. 5, 1993

[54] SOCKETLESS LAMP WITH SPRING SIDE CONTACTS

[75] Inventors: Rolland B. Hall, Keene; John A. Bergin, Hancock, both of N.H.

[73] Assignee: GTE Products Corporation, Danvers, Mass.

[21] Appl. No.: 806,194

[22] Filed: Dec. 13, 1991

[51] Int. Cl.[5] ..... H01J 5/48; H01J 5/50

[52] U.S. Cl. ..... 313/318; 313/49; 439/613; 439/614

[58] Field of Search ..... 313/318, 49; 439/611, 439/613, 614, 619

[56] References Cited

U.S. PATENT DOCUMENTS 3,197,668 7/1965 Horan ..... 313/318
4,054,346 10/1977 Schultz et al. ..... 313/318
4,463,278 7/1984 Kosmatka et al. ..... 313/318
4,623,958 11/1986 Van der Linde et al. ..... 313/318
4,947,082 8/1990 French ..... 313/318

FOREIGN PATENT DOCUMENTS 3047210 7/1982 Fed. Rep. of Germany ..... 313/318

*Primary Examiner*—Donald J. Yusko
*Assistant Examiner*—N. D. Patel
*Attorney, Agent, or Firm*—William E. Meyer

[57] ABSTRACT

A plug in lamp with spring side contacts having bulb, holder, lugs, and a seal is disclosed. The lugs have outwardly arced spring sections that are compressed during lamp insertion, thereby forming a latching mechanism to hold the lugs and lamp in place, while simultaneously providing electric power through the lugs. Sealing structures are disclosed that protect the welds, and others electrical features from environmental degradation.

15 Claims, 3 Drawing Sheets

SOCKETLESS LAMP WITH SPRING SIDE CONTACTS

TECHNICAL FIELD

The invention relates to electric lamps and particularly to electric lamps with insertable bases. More particularly the invention is concerned with an electric lamp with an insertable base having spring contacts.

BACKGROUND ART

Automobile taillights are subject to a number of demanding requirements. The lamps must be inexpensive. The lamps must be assembled into vehicles during manufacture without great effort. The lamps must also be replaceable by a customer. Nonetheless, the lamps must still survive the temperature, weather, and road condition extremes typical of automobile use. In particular, this means the electrical contacts must survive the water, oil, salt, and dirt that at times are blasted around the lamp housing. There is then a need for an inexpensive, durable vehicle taillight.

U.S. Pat. No. 4,947,082 issued to Alan P. French on Aug. 7, 1990 for a Sealing Arrangement for a Lamp Housing shows a lamp coupled to a circuit board, using a ring seal.

DISCLOSURE OF THE INVENTION

A socketless lamp with spring side contacts may be formed with a bulb, a holder, a cap and lugs. The bulb is designed to enclose a light source, and has a bulb seal and at least two leads extending for electrical connection. The holder is designed to hold the bulb, and has a top wall, an interior wall defining a socket cavity sufficient to receive at least a portion of the bulb seal, formed with internal channels extending from the socket cavity through the holder to an opposite bottom side of the holder, and lug guides formed on an exterior holder surface. A cap with an interior surface may be mated with and enclosing the bottom side of the holder. At least two lugs each having a respective interior end and a lug spring region, each lug are respectively positioned adjacent the bottom side of the holder, with each respective lug spring region extending first away from the holder and towards the bulb, and then extending back towards the holder to couple a portion of the extending lug in the lug guide.

BEST MODE FOR CARRYING OUT THE INVENTION

Figure 1:
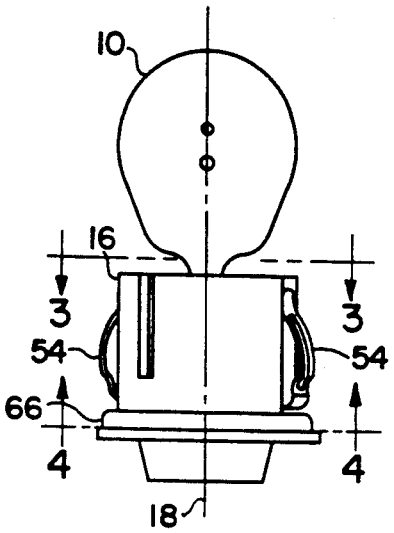
FIG. 1 snows a side view of a preferred embodiment of a socketless lamp with spring side contacts.
Figure 2:
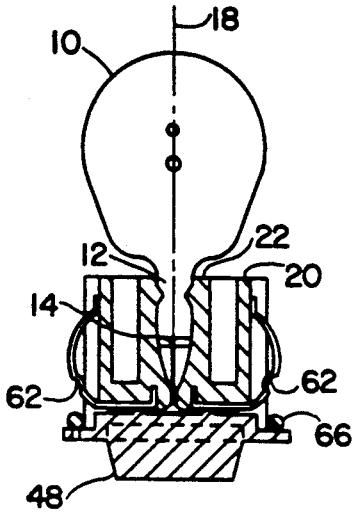
FIG. 2 shows an axial cross section A—A of a preferred embodiment of a socketless lamp with spring side contacts.
Figure 3:
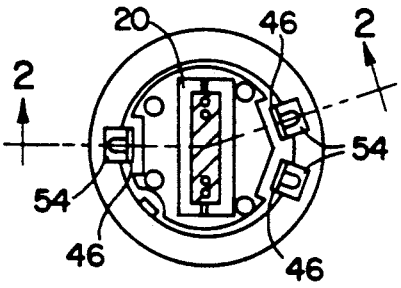
FIG. 3 shows a cross section B—B of a preferred embodiment of a socketless lamp with spring side contacts.
Figure 4:
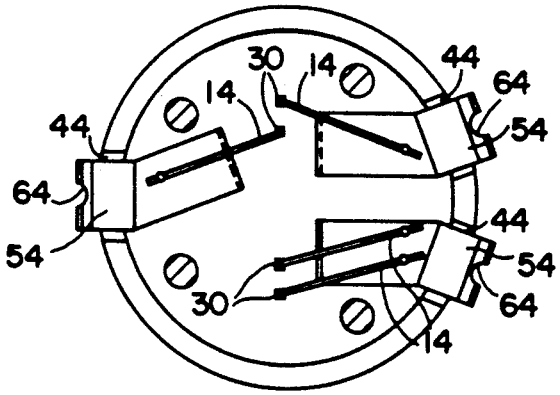
FIG. 4 shows a cross section C—C of a preferred embodiment of a socketless lamp with spring side contacts.

FIG. 1 shows a side view preferred embodiment of a socketless lamp with spring side contacts. FIG. 2 shows an axial cross section A—A of a preferred embodiment of a socketless lamp with spring side contacts. The socketless lamp with spring side contacts is assembled from a bulb 10, a base 16, two or more lugs 54, and a base seal 66.

The bulb 10 encloses a light source, and has a bulb seal 12 with two or more leads 14 extending from the light source, through the bulb seal 12 to the exterior for electrical connection. The bulb seal 12 may included formed surface features such as indentations, or protuberances to enhance coupling of the bulb 10 to the base 16. The preferred bulb seal 12 has a press seal, with two or more indentations to properly position the bulb 10 in the base 16. The preferred leads 14 are round molybdenum wires that provide electrical connection for the light source enclosed in the bulb 10. By way of example bulb 10 is shown as a press sealed, S-8 wedge type bulb 10, typical of present day automobile taillights, although the bulb 10 may be of any other suitable configuration.

Figure 5:
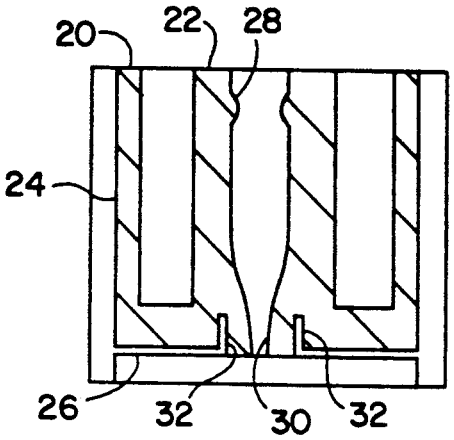
FIG. 5 shows an axial cross sectional view of the preferred embodiment of a holder.

The bulb 10 is held by the base 16. The base 16 may be segmented into subsections according to a variety of designs. The Applicants prefer a two piece base 16 formed from a holder 20, and a cap 48. In the preferred embodiment, the bulb 10 is held by the holder 20. FIG. 5 shows an axial cross sectional view of the preferred embodiment of a holder 20. The preferred holder 20 has the overall form of a cylinder, with the axis 18, a top 22, a side 24 and a bottom 26. Formed in the top 22 is an internal wall 28 defining a socket cavity formed to mate with the bulb seal 12. The internal wall 28 may be formed with indentations or protuberances that conform, at least in part, with the surface of the bulb seal 12. The preferred holder 20 is further formed with internal lead channels 30 that extend through the holder 20 from the socket cavity to open on the bottom 26. The leads 14 may be fitted through the internal channels 30. The bottom 26 is additionally formed with anchor slots 32 that extend perpendicularly into the preferred embodiment of the bottom. The anchor slots 32 are shaped to receive and retain the tips of the interior lug ends 56.

The preferred bottom 26 includes lug grooves 44 that extend to the side 24, and then open on to lug guides 46. Depressed slots may be formed on the side 24 to function as lug guides 46. The lug guides 46 guide or contain at least portions of the lugs 54. Extending in the base axis 18 direction, the preferred lug guides 46 are grooves formed in the holder side 24. Each lug guide 46 has sufficient width to receive at least a portion of a respective lug 54.

Figure 6:
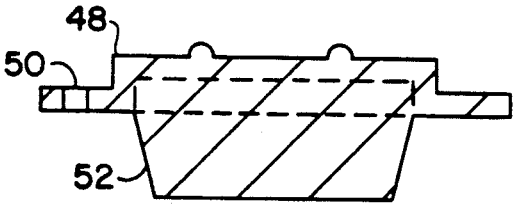
FIG. 6 shows an axial cross sectional view of the preferred embodiment of a cap.

FIG. 6 shows a cross sectional view of the preferred embodiment of a cap 48. The bottom 26 may be closed from the exterior by the preferred cap 48. The preferred cap 48 is circular disk having a lip edge 50, and a formed finger tab 52 extending perpendicularly from the circular disk, and diametrically to the lamp base axis 18. The bottom 26 may be mated to the lip edge 50. The finger tab 52 enables hand insertion of the lamp. When positioned adjacent the holder 20, the cap 48 closes off an internal volume that includes portions of the leads 14, and the lugs 54.

Figure 7:
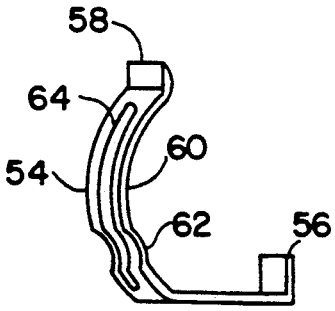
FIG. 7 shows a perspective view of the preferred embodiment of a lug.
Figure 8:
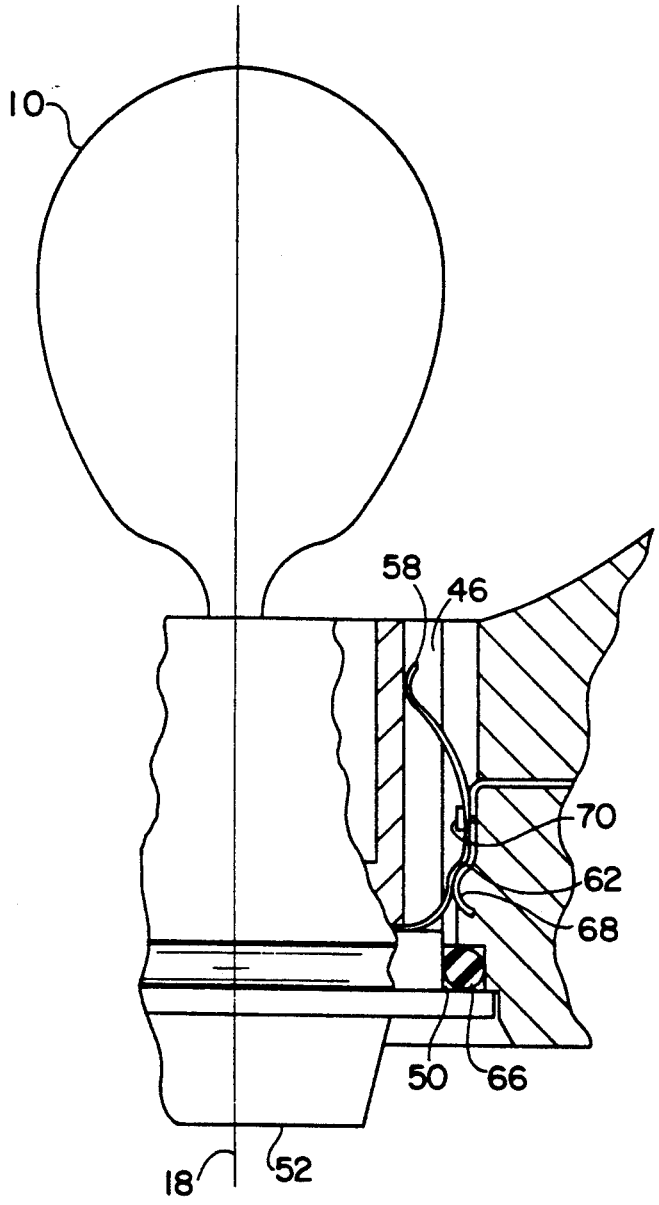
FIG. 8 shows an axial cross sectional view of a preferred embodiment of a socketless lamp with spring side contacts mounted in a reflector housing in cross section, and partially broken away.

FIG. 7 shows a perspective view of the preferred embodiment of a lug 54. Each of the preferred lugs 54 are formed from flat, blade like conductors, with appropriate bends made perpendicular to the width of the blade. Each lug 54 has an interior lug end 56 and an exterior lug end 58. The interior lug end 56 is formed to fit in an associated anchor slot 32, and have a contact region for welding, and pressure contacting the lead 14 to the lug 54. The exterior lug end 58 has a lug spring region 60 with a notch 62, and an internally formed lug slot 64. The lug width allows the lugs 54 to be positioned in the lug groove 44, and for a portion of the exterior lug end 58 to be positioned in the lug guide 46. Each respective interior lug end 56 is formed to fit adjacent the bottom 26, and to be electrically connected to a lamp lead 14. Each anchor slot 32 is designed to receive the interior lug end 56 tip end. The preferred embodiment of the interior lug end 56 is a bent tip that may be snugly fitted in place and has a flat first contact point where an electrical connection to the lead 14 may be made.

Positioned along exterior portion of the lug 54, the lug spring region 60 comprises one or more bends in the lug 54, transverse to the lug length, and the lug width. The preferred lug spring region 60 is an arced section starting near a point where the lug 54 emerges from the lug groove 44, and extending out and away from the base 16, while arcing upwards, towards the bulb 10, and back to the lug guide 46.

Formed in the preferred lug, is an notch 62. The notch 62 comprises a smaller diameter arced section of the lug 54 that may mate with a conformally shaped contact 68 of a power contact. The preferred notch 62 is an indented circular, section. The preferred lug 54 further includes an internally formed lug slot 64 extending between the notch 62 and the exterior lug end 58. The lug slot 64 may be mated with a complementary or smaller projecting tab 70, extending from a power contact. The exterior lug end 58 of each respective lug is designed to ride in an associated lug guide 46. In one embodiment, the exterior lug end 58 is bent away from the lug guide 46 to form a foot that travels in the lug guide 46. The lug guide 46 prevents the exterior lug end 58 or lug foot from wandering from the plane of the base axis 18 and the lug guide 46. By way of example, the lugs 54 are shown as flat, spring metal pieces although the lugs 54 may be of any other suitable cross section configuration.

Positioned around the base 16 is a base seal 66. The base seal 66 is formed to seal between a point below the lug grooves 44, where the lugs 54 emerge to the exterior, and the bottom 26. The preferred base seal 66 is an O-ring positioned around the bottom end of the holder 20, and adjacent the lip edge of the cap 48.

The preferred socketless lamp is assembled by threading the lugs 54 through the lug grooves 44, so the interior lug ends 56 are sealed in the anchor slots 32. The exterior lug ends 58 are positioned to ride in the lug guides 46. The bulb leads 14 are then threaded through the lead channels 30 to emerge adjacent the interior lug ends 56. The bulb seal 12 is then inserted into the holder cavity so the surface features of the bulb seal 12 mate with the surface features of the holder internal wall 28. The bulb 10 is then firmly held by the holder 20. Each lead 14 is then positioned adjacent an interior lug end 56 of a respective lug 54. The leads 14 are then welded to the lugs 54. The cap 48 is then mated to the bottom 26, with bumps formed on the cap 48 push against the leads 14 to mechanically pin the leads 14 against the lugs 54. The holder 20, and cap 48 are then ultrasonically welded together. The welded holder 20, and cap 48 define an interior volume that encloses the bulb lead 14 to lug 54 contacts from exterior environmental influences. The O-ring base seal 66 is then positioned around the holder 20, adjacent the cap lip 50.

The lamp capsule is used by inserting the bulb 10 through a reflector hole or similar support hole. As the bulb passes into the hole, the lugs 54 meet electrical power contacts 68 formed in the reflector hole. With further insertion, the lugs 54 are compressed between the reflector hole and the base 16 with the exterior lug ends meeting the base 16 in the lug guides 46. With still further insertion, tabs 70 formed on the power contacts 68 mate with the lug slots 64 preventing the lugs 54 from loosing contact with the power contacts 68. Finally the lug notch 62 rides over and is trapped by a conformal section of the power contact 68. The capsule is then seated against the reflector, in electrical contact with the power contacts 68, for example a bump 72 that fits in the lug notch 62. The exterior lug ends 58 are then compressed in spring contact with the power contacts 68, and positioned by the lug guides 46 positioning the exterior lug ends 58, the power contact tabs 70 slotted in the lug slots 64, and the lug notch 62 mated to the corresponding power contact bump 72. The capsule seal is compressed between the capsule, and the reflector thereby sealing the lamp from external environmental influences.

In one working example, the lamp was 5.87 centimeter (2.31 inch) from top to bottom. The lamp had four leads electrically connected to three lugs The bulb was 2.54 centimeter (1.00 inch) in diameter. The holder was 2.54 centimeter (1.00 inch) in diameter for most of its height, and was 2.23 centimeter (0.88 inch) from top to the exterior side of the cap. An O-ring was positioned around the holder, adjacent a lip formed by the cap. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A plug in lamp with spring side contacts comprising:

a) a bulb enclosing a light source, and having a bulb seal and at leas two leads extending for electrical connection, b) a holder to hold the bulb having a top wall, an interior wall defining a socket cavity sufficient to receive at least a portion of the bulb seal, formed with internal channels extending from the socket cavity through the holder to an opposite bottom side of the holder, and lug guides formed on an exterior holder surface, c) a cap with an interior surface mated with and enclosing the bottom side of the holder, and an opposite exterior cap surface, and d) at least two lugs each having a respective interior end and a lug spring region, each lug respectively positioned adjacent the bottom side of the holder, and the respective lug spring region extending first away from the holder and towards the bulb, and then extending back towards the holder to couple a portion of the extending lug in the lug guide.

2. The plug in lamp in claim 1, further including a base seal positioned peripherally around the holder and intermediate the lug guide and the exterior cap surface side of the cap.

3. The plug in lamp in claim 1, wherein the holder has an exterior surface formed with lug grooves extending from a region near where the formed internal channels emerge on the bottom side of the holder, and extend across the bottom side of the holder to the exterior surface near where the lug guides are formed.

4. The plug in lamp in claim 1, wherein the leads are welded to the lugs.

5. The plug in lamp in claim 1, wherein at least one of the lugs is formed with an interior wall defining a lug slot in the lug spring region.

6. The plug in lamp in claim 1, wherein the lug spring region includes an interior wall defining a lug slot extending along the exterior end of the lug, and having sufficient width to allow the insertion of a mechanical guide for the lug.

7. The plug in lamp in claim 1, wherein the holder is formed from an inner holder having an inner connection face and an outer holder having an outer connection face, the inner holder and the outer holder being mateable to define a cavity substantially between the inner connection face and the outer connection face surrounding the interior lugs ends.

8. The plugs in lamp in claim 7, wherein the holder includes compression contacts adjacent the lead emerging in the defined cavity and the lug to press the lead against the lug, and in turn the lug against the holder.

9. A plug in lamp with spring side contacts comprising:

a) a bulb enclosing a light source, and having a bulb seal with at least two leads extending for electrical connection, b) a holder to hold the bulb having a top, an interior wall defining a socket cavity open to the top and sufficient to receive at least a portion of the bulb seal, formed with internal channels extending from the socket cavity through the holder to a bottom side of the holder, the bottom side being formed with lug grooves, and a side of the holder formed with lug guides, c) a cap with an interior surface to mate with the holder and enclose the bottom side of the holder, and an opposite exterior surface, d) at least two lugs, each lug having a respective interior end, and an exterior end having a lug spring region, and a notch; each lug having at least a portion of the interior end respectively positioned in a respective lug groove with the respective portion of the interior lug end adjacent the bottom of the holder, and the respective lug exterior end extending first away from the holder and towards the bulb, and further extending so a portion of the exterior end is positioned in the respective lug guide, and e) a base seal positioned peripherally around the holder and intermediate the lug groove and the exterior of the cap.

10. The plug in lamp in claim 9, wherein the notch is a curvilinear indentation extending towards the holder.

11. The plug in lamp in claim 9, wherein the exterior end includes a tip end formed as a foot to fit in and be guided by the lug guide.

12. The plug in lamp in claim 9, wherein the base seal is an O-ring.

13. The plug in lamp in claim 9, wherein the holder includes an O-ring positioned around an exterior surface to make a hermetic seal between the exterior lug ends and the exterior surface of the cap.

14. A plug in lamp comprising:

a) a light source having a light transmissive envelope, and electrical leads, b) a holder, having an inner side with a support for the envelope, having a lead channel extending from the support to a closed cavity defined within the holder, the holder being coupled to a portion of the light source to support the light source, with at least one electrical lead threaded through the lead channel to emerge in the defined cavity, c) at least one electrical connector, having a first connection end to receive supplied electric power, and a second connection end electrically coupled to the electrical lead, and d) a circumferential sealing means formed along the surface of the holder, separating the surface of the holder into an inner side adjacent the light source support, and an outer side; the sealing means defining a geometric circumference sufficient to allow the light source and support to pass therethrough; the first connection end of at least one electrical connector emerging from the holder on the inner side of the holder for electrical connection.

15. A plug in lamp comprising:

a) a light source having a light transmissive envelope, and electrical leads, b) an inner holder, having an inner side with a support for the envelope, having a lead channel extending from the support through the inner holder to an inner sealing face formed on the inner holder, the inner holder being positioned about a portion of the light source to support the light source, with at least one electrical lead threaded through the lead channel to emerge adjacent the inner sealing face, c) at least one electrical connector, having a first connection end to receive supplied electric power, and a second connection end electrically coupled to the electrical lead to form an electrical connection, and d) an outer holder, having an outer sealing face, the outer holder being coupled to the inner holder to enclose the electrical connection between the electrical lead and the electrical connector between the inner sealing face and the outer sealing face, thereby forming a combined holder for the light source, the first connection ends of the electrical connector emerging from the combined holder on the inner side of the combined holder.

* * * * *